US006600825B1

(12) United States Patent
Leysieffer

(10) Patent No.: US 6,600,825 B1
(45) Date of Patent: Jul. 29, 2003

(54) HERMETICALLY SEALED HEARING AID CONVERTER AND HEARING AIDS WITH THIS CONVERTER

(75) Inventor: Hans Leysieffer, Taufkirchen (DE)

(73) Assignee: Phonak AG, Stafa (CH)

( * ) Notice: Subject to any disclaimer, the term of this patent is extended or adjusted under 35 U.S.C. 154(b) by 0 days.

(21) Appl. No.: 09/465,390

(22) Filed: Dec. 17, 1999

(30) Foreign Application Priority Data

Dec. 17, 1998 (DE) ..... 198 58 399

(51) Int. Cl.[7] ..... H04R 25/00
(52) U.S. Cl. ..... 381/328; 381/330
(58) Field of Search ..... 381/328, 23.1, 381/325, 330, 312, 162, 417, 418

(56) References Cited

U.S. PATENT DOCUMENTS 3,742,156 A * 6/1973 Broersma
4,447,677 A * 5/1984 Miyahra et al.
5,277,694 A 1/1994 Leysieffer et al.
5,624,376 A 4/1997 Ball et al.
5,755,743 A 5/1998 Volz et al.
5,802,198 A * 9/1998 Beavers et al.
5,809,157 A * 9/1998 Grumazescu

FOREIGN PATENT DOCUMENTS

| | | |
|---|---|---|
| DE | 42 21 866 | 6/1994 |
| EP | 0 499 940 | 8/1992 |
| EP | 0 548 580 | 6/1993 |

* cited by examiner

*Primary Examiner*—Sinh Tran
(74) *Attorney, Agent, or Firm*—Nixon Peabody LLP; David S. Safran

(57) ABSTRACT

An electroacoustic converter for hearing aids including an electromechanical converter drive unit and a hermetically sealed metallic converter housing for enclosing the drive unit, the converter housing including one wall which is made as a bendable converter membrane, where the output-side of the converter drive unit which vibrates mechanically is coupled to the converter membrane in a manner that the converter membrane is excited in to bending vibrations to result in sound emission outside of the converter housing.

40 Claims, 6 Drawing Sheets

FIG.4
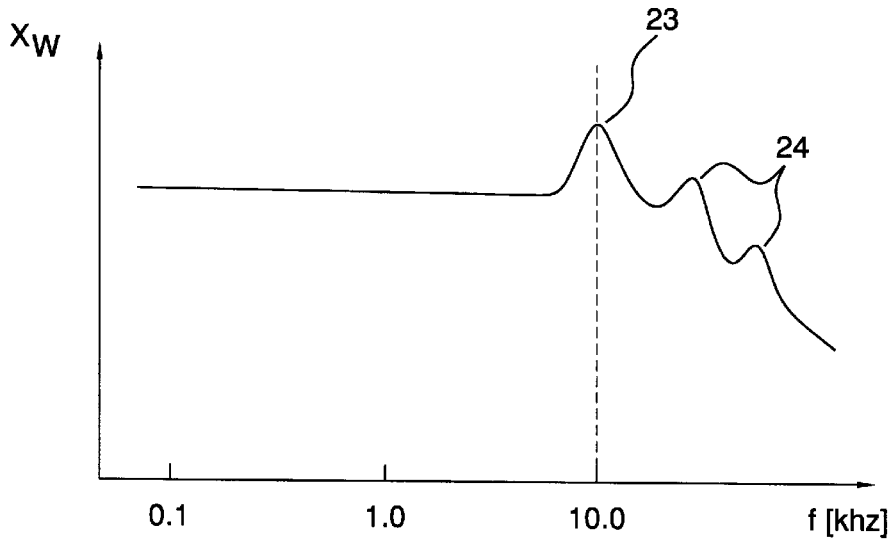
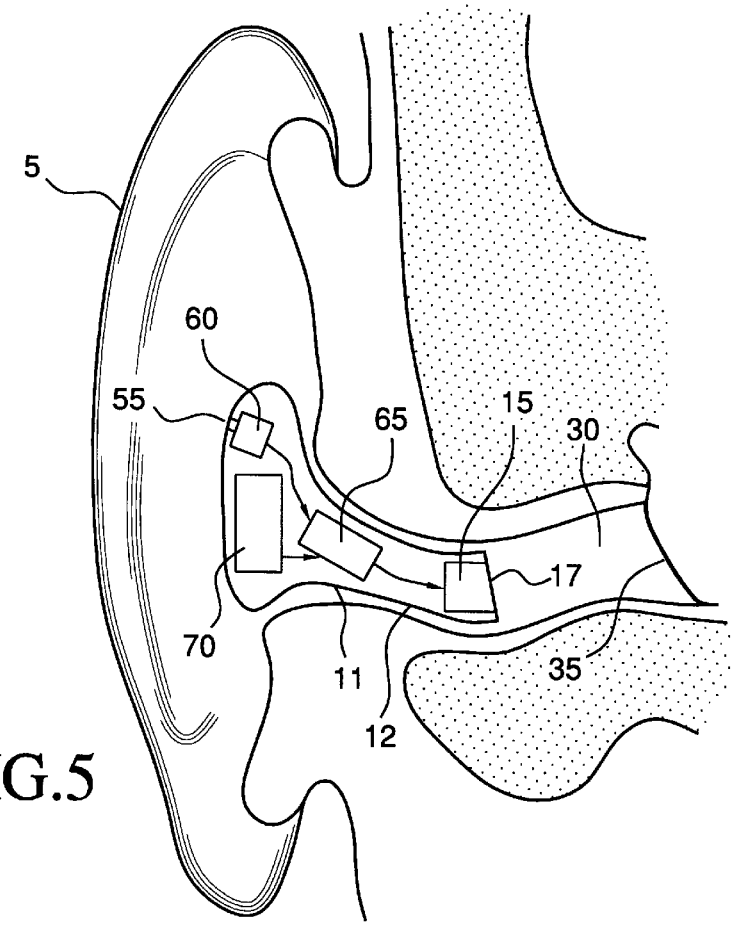
FIG.5

HERMETICALLY SEALED HEARING AID CONVERTER AND HEARING AIDS WITH THIS CONVERTER

BACKGROUND OF THE INVENTION

1. Field of the Invention

The present invention relates to converters for hearing aids used in the rehabilitation of damaged inner ears. In particular, the present invention relates to such converters for hearing aids which are hermetically sealed.

2. Description of the Related Art

Hearing aids for rehabilitating damaged inner ear typically pick up sound with a microphone and using this microphone, convert the sound into an electrical signal. This signal is processed in analog or digital form by an electronic unit and is amplified. The amplified electrical signal is basically sent to an electroacoustic converter which acts as a loudspeaker and is also called an "earphone". This electroacoustic earphone radiates the amplified electrical signal into the auditory canal of the pertinent ear. The auditory canal, in many cases, is sealed by an individually produced ear fitting piece (so-called "otoplasty") in order to first, function as an acoustic pressure chamber which is formed by the residual volume up to the eardrum, and second, to prevent acoustic feedback between the microphone and the earphone at high degrees of amplification. Basically, there are two different designs of these hearing aids. First, in the "behind-the-ear hearing aids" (HdO), the important components of the hearing aid such as the microphone, electronic unit, battery and earphone are located in a common housing which is worn behind the ear. The amplified acoustic signal is decoupled from the earphone by a sound conduction tube and routed via the auricular muscle to the ear fitting piece and supplied through it to the auditory canal. The hearing aid can also be mounted on the frames of glasses. Second, in the "In-the-ear device" (IdO) type of hearing aid, all the aforementioned elements of the hearing aid are located in a common housing which is worn in the auricular muscle in the area of the outer auditory canal. One such in-the-ear device is integrated, for example, into the individual ear fitting piece or represents the ear fitting piece itself by a corresponding outer structure. In the in-the-ear design, the sound feed tube is eliminated since the sound exit opening is located on the side of the hearing aid facing the auditory canal and the earphone radiates the amplified acoustic signal directly into the auditory canal.

Hearing aids of the two aforementioned designs have fundamentally the following disadvantages:

The converters (earphones) of almost all hearing aids operate based on the electromagnetic conversion principle due to reasons of electrical efficiency and the optimization of the battery service life. This results in inevitable occurrence of nonlinear distortions especially at high converter currents and the pertinent output levels which adversely affect sound quality.

In addition, the first mechanical resonant frequency of this converter is generally in the middle of the spectral transmission range. This, and other physical and construction aspects, leads to an uneven frequency response and thus, undulations of the output acoustic pressure level. These resonances within the transmission range also fundamentally cause phase rotations. Both of these aspects contribute to reduced transmission quality.

The converter (earphones) are mechanically "open" on the output side as a result of the acoustic signal to be transmitted, thus, the outside air (except for a few cases where additional flow screens are provided) can penetrate relatively unhindered into the interior of the converter. Thus, the converter is exposed and almost unprotected to all weather and environmental effects, especially atmospheric humidity. These environmental effects are to a largely responsible for frequently occurring performance reductions of the converter operating parameters or even the failure of this component.

Especially in the in-the-ear devices, as a result of the local arrangement of the earphone in the outer (for maximally miniaturized devices) or inner auditory canal, fouling of the acoustic access channel by ear wax which is the product of the natural cleaning process of the auditory canal leads to adverse effects or failures of the earphone and thus, the hearing aid.

SUMMARY OF THE INVENTION

The primary object of this invention is to minimize or eliminate the aforementioned defects of known prior art hearing aid converters.

In accordance with one embodiment of the present invention, this and other objects and advantages are achieved by providing an electroacoustic converter for hearing aids including an electromechanical converter drive unit, a hermetically sealed metallic converter housing for enclosing the drive unit, the converter housing including one wall which is made as a bendable converter membrane, where the output-side of the converter drive unit which vibrates mechanically is coupled to the converter membrane in a manner that the converter membrane is excited in to bending vibrations thereby resulting in sound emission outside of the converter housing. The converter membrane acts as an earphone membrane which radiates sound outside the converter. The electromechanical converter drive unit within the converter may be based and operate on all known converter principles, especially piezoelectric, dielectric, electromagnetic, electrodynamic and magnetostrictive converter principles.

The converter housing is preferably cylindrical, especially circularly cylindrical, and may have a housing part which is open on one side, the open side being hermetically sealed gas tight by the converter membrane.

The housing part and/or the converter membrane can be made of a corrosion resistant, stainless metal, such as high grade steel or other body-compatible metal such as titanium, platinum, niobium, tantalum or their alloys.

Preferably, the housing part is provided with at least one single-pole, a hermetically sealed electrical housing feed through and the ground potential lying on the housing part. The housing feed through can be advantageously provided using metal-ceramic connections soldered gas tight with aluminum oxide ceramic as the insulator and at least one platinum-iridium wire as the electrical feed through lead.

The electromechanical converter drive unit is preferably a piezoelectric ceramic wafer which can be made circular and applied to the inside of the converter membrane as an electromechanically active element which, together with the converter membrane, represents an electromechanically active heteromorph composite element. Here, as in a bimorph element, the piezoelectric transverse effect is used except that the partner of the composite here does not consist of a second piezoelectrically active element, but instead, consists of the passive converter membrane of geometry similar to the piezoelement. The piezoelectric ceramic wafer can be provided with a very thin, electrically conductive coating on both sides which is used as the electrode surface and can consist especially of lead zirconate titanate. If an electrical field is applied to the piezoelectric ceramic wafer, the wafer changes its geometry, preferably in the radial direction, as a result of the transverse piezoeffect. Since extension or radial shortening is prevented by the mechanically strong connection to the passive converter membrane, sagging of the composite element takes place which is maximum in the middle with the corresponding edge support of the converter membrane.

The thickness of the converter membrane and the thickness of the piezoelectric ceramic wafer may be roughly the same and may be in the range of 0.05 mm to 0.15 mm. Furthermore, the converter membrane and the piezoelectric ceramic wafer may have roughly the same E-modulus. One especially simple and reliable structure is obtained when both the converter membrane and the housing part are electrically conductive, the piezoelectric ceramic wafer being connected electrically conductively to the converter membrane by an electrically conductive cement and the housing part forming one of at least two electric converter terminals. The radius of the converter membrane is preferably larger by a factor of 1.2 to 2.0, preferably a factor of roughly 1.4, than the radius of the piezoelectric ceramic wafer.

According to one modified embodiment of the present invention, the electromechanical converter drive unit is an electromagnet arrangement which has a component which is fixed with reference to the converter housing and a vibratory component which is coupled to the inside of the converter membrane. By using the electromagnetic converter principle, a converter frequency response, which is especially favorable for the low frequencies of the hearing range, can be achieved so that an adequate hearing impression is enabled with a sufficient loudness level using low electrical voltages.

The vibratory component of the electromagnet arrangement is preferably attached substantially in the center of the converter membrane. In particular, a permanent magnet which forms the vibratory component can be attached to the inside of the converter membrane while an electromagnetic coil operable to cause the permanent magnet to vibrate is permanently attached in the converter housing. The permanent magnet may be made as a magnetic pin and the coil can be a ring coil with a middle opening into which the magnetic pin is movably disposed. In this way, a converter arrangement with an especially small moving mass is obtained which can promptly and faithfully follow the changes of the electrical signal applied to the magnetic coil. However, it is also possible to attach the magnetic coil to the vibratory membrane and to fix the magnet with respect to the converter housing instead.

Regardless of the converter principle used in a particular application of the converter, by selecting the mechanical properties of the converter membrane and the converter drive unit, the vibratory system which encompasses these components is tuned such that the first mechanical resonant frequency of the entire converter is spectrally at the top end of the transmission range, advantageously in the range from 4 to 12 kHz and preferably, roughly 10 kHz. The converter drive unit may be electrically triggered such that the deflection of the converter membrane is impressed independently of frequency as far as the first resonant frequency.

In addition, a converter driver can also be accommodated in the converter housing.

The electroacoustic converter in accordance with the present invention may be also used in a hearing aid which has the electroacoustic converter of the above described type as the output-side acoustic converter. Such a hearing aid can be made as a behind-the-ear device, in-the-ear device, or a glasses device.

Regardless of the hearing aid type, the electroacoustic converter together with a microphone, a power supply source, signal-processing and amplifying elements and all other possible components necessary for a hearing aid function can be accommodated in a hearing aid housing.

Likewise, regardless of the hearing aid type, the electroacoustic converter of the present invention can be accommodated in a separate housing and by at least one two-pole electrical line, be connected to the actual hearing aid which contains in the conventional manner a microphone, a power supply source, signal-processing and amplifying elements and all other possible components necessary for a hearing aid to function. Here, the separate housing which contains the electroacoustic converter can be advantageously integrated into an ear fitting piece. The ear fitting piece which contains the electroacoustic converter can be mechanically connected to a behind-the-ear hearing aid via a flexibly deformable coupling element which allows individual matching to the anatomy of the outer ear and contains the electrical feed line to the converter.

When the electroacoustic converter is installed in the ear fitting piece or directly in an in-the-ear device, the converter housing is advantageously arranged such that the converter membrane ends almost flush with the area of the ear fitting piece or the in-the-ear device housing which faces the auditory canal.

Preferably, the hearing aid is equipped with an electronic converter driver which matches the signal processing electronics of the hearing aid to the selected electromechanical principle of the converter drive unit within the converter to the respective objectives of the output level and the frequency range accordingly. The converter driver can be integrated into the signal-processing electronics of the hearing aid or can be an independent electronic module. In the latter case, the converter driver can be accommodated in the hearing aid housing or the converter housing, or placed between the hearing aid and the electroacoustic converter. For a converter driver located outside the hearing aid housing, the electrical supply may be provided using the principle of phantom feed through a two-pole electrical connection between the hearing aid electronics and the converter driver, the DC voltage which supplies the converter driver being superimposed on a signal-containing AC voltage. The converter driver can also be connected via detachable mechanical or electrical plug connections to the hearing aid or the electroacoustic converter.

The converter driver may also have an integrating function for connection with a pulsewidth modulated output stage in a fully digital hearing aid having a pulse-width modulated output stage.

In the following, advantageous embodiments of the invention are detailed using the drawings.

BRIEF DESCRIPTION OF THE DRAWINGS

FIG. 4 shows one example of center point deflection of the converter membrane of a hearing aid converter relative to frequency in accordance with one embodiment of the present invention;

FIG. 5 shows a schematic illustration of an in-the-ear device equipped with a hearing aid converter in accordance with the present invention;

DETAILED DESCRIPTION OF THE PREFERRED EMBODIMENT

Figure 1:
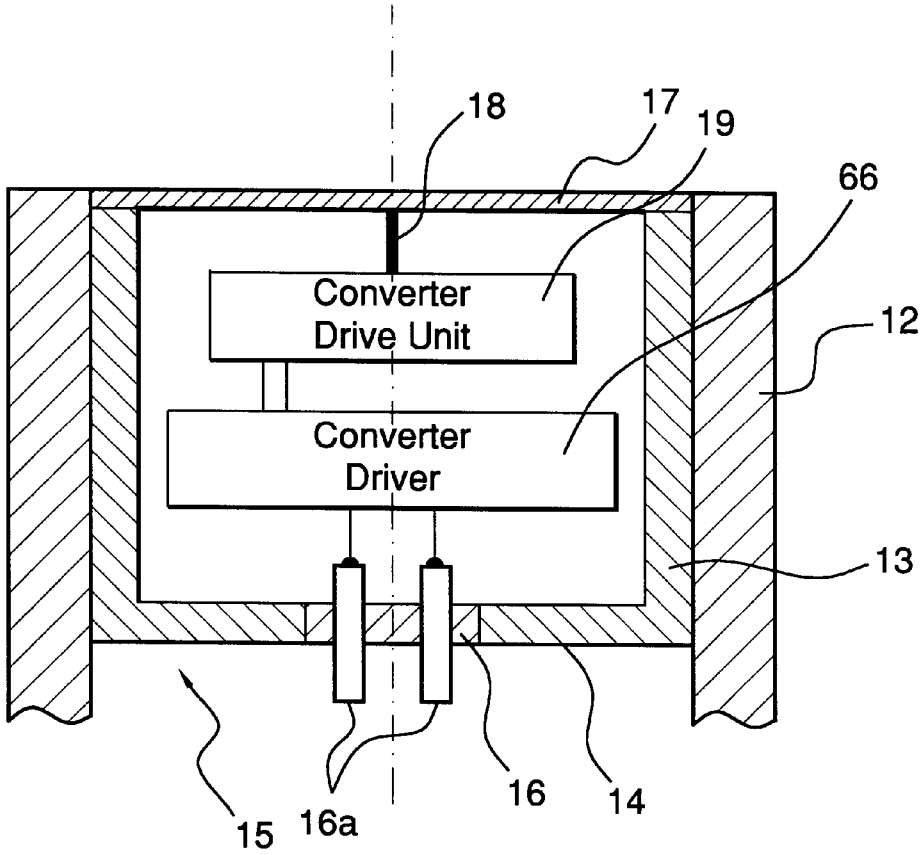
FIG. 1 shows a schematic cross-sectional view of a hearing aid converter in accordance with one embodiment of the present invention.

FIG. 1 schematically shows the general structure of one embodiment of an electroacoustic hearing aid converter which labeled 15 hereinbelow. In this embodiment, the housing (or alternatively, the ear fitting piece of an in-the-ear or a behind-the-ear device) is represented by a wall 12 in which the hearing aid converter 15 is placed such that its sound-emitting membrane 17 ends at least roughly as flush as possible with the area of the housing or ear fitting piece that faces the auditory canal. The hearing aid converter 15 has preferably a circular cylindrical converter housing 14 which is closed on all sides. The side which is shown on top in the drawing is formed by the converter membrane 17. The membrane 17 which is produced preferably from a non-corrosive metal (for example high quality steel, titanium, platinum, niobium, tantalum or their alloys) hermetically seals the open side of the housing part 13 which is open on one side. Except for the membrane 17, all walls of the converter housing 14 are made mechanically rigid.

The membrane 17 is connected by a mechanically stiff connecting element 18 to the converter drive unit 19 in a substantially middle area of the membrane 17. This converter drive unit 19 represents the actual electromechanical converter which, via the connection element 18, excites the membrane 17 to dynamic bending vibrations which cause sound to radiate to the outside of the converter housing 14. The mechanical parameters such as dynamic mass portions and stiffness of the membrane 17, the connection element 18 and the converter drive unit 19 may all be selected such that the first mechanical resonant frequency is tuned to be spectrally at a top end of the desired transmission range thereby setting the converter 15 to be above the resonant frequency. Thus, with the corresponding electronic triggering by providing voltage or current depending on the converter principle by which the converter drive unit 19 operates, the deflection of the membrane 17 below the resonant frequency attained which is, to a large extent independent and uninfluenced by the resonant frequency.

In this regard, it should be noted that the electromechanical converter drive unit within the converter 15 may be based and operate on all known converter principles including piezoelectric, dielectric, electromagnetic, electrodynamic and magnetostrictive converter principles. Some of these types of converters are discussed in more detail below. Regardless of the converter principle used in a particular application of the converter 15, by selecting the mechanical properties of the converter membrane and the converter drive unit, the vibratory system which encompasses these components is tuned such that the first mechanical resonant frequency of the entire converter is spectrally at the top end of the transmission range, advantageously in the range from 4 to 12 kHz and preferably, roughly 10 kHz. The converter drive unit may be electrically triggered such that the deflection of the converter membrane is impressed independently of frequency as far as the first resonant frequency.

Referring again to FIG. 1, the supplying of the electrical signal for the converter drive unit 19 takes place via a hermetically gas tight, electrical feed through 16. The electrical feed through 16 is provided in the converter housing 14 with electrical converter terminals 16*a* which are shown by way of example in FIG. 1 as having two poles. The electrical converter terminals 16a can lead directly to the converter drive unit 19, or alternatively as shown in FIG. 1, to an electrical or electronic converter driver 66 which is connected upstream of the converter drive unit 19 and which may also be accommodated in the converter housing 14 as shown by way of example in FIG. 1. The electrical feed through 16 can be advantageously provided using terminals 16*a* which may be metal-ceramic connections soldered gas tight with aluminum oxide ceramic as the insulator and at least one platinum-iridium wire as the electrical feed through lead.

The converter driver 66, depending on the electromechanical converter principle of the unit 19 and the parameters of the triggering electrical signal on the terminals 16a, conditions this electrical triggering signal. The converter driver 66 is generally used as a matching component between the electronic unit 65 of the hearing aid 10 or 11 detailed below (FIGS. 5, 6, 7 and 8) and the converter 15 so that the converter drive unit's output and frequency corresponds to the signal obtained from the hearing aid. This electronic matching component advantageously enables use of existing electronic circuits of existing hearing aids so that completely new development of these circuits can be avoided. The converter driver 66, depending on the conversion principle used in the converter drive unit 19, can contain components of a further amplifying nature to raise the power supply voltage range via the corresponding DC/DC converter, undertake electrical impedance matching, and the like. Supply of the driver 66 with electrical operating energy takes place preferably via the principle of electrical phantom feed with a DC voltage component being superimposed on the signal-carrying line. Thus only one two-pole connection between the electronic unit 65 of the hearing aid and the converter element 15 is necessary. Basically, the driver 66 can also be omitted, and the corresponding electronic matching can be done in the hearing aid itself so that especially for an in-the-ear application as shown in FIG. 1, the volumetric requirement of the converter 15 can be minimized.

Figure 2:
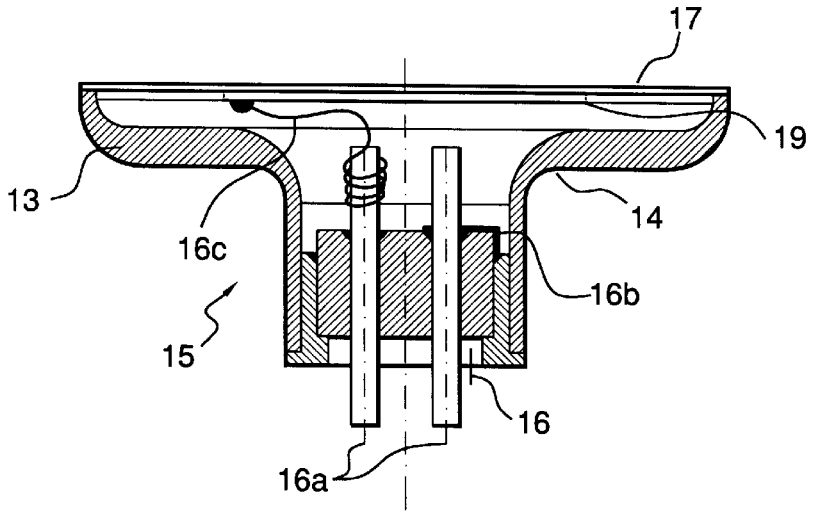
FIG. 2 shows a cross-sectional view of a hearing aid converter in accordance with the present invention including a piezoelectric drive unit.

One preferred embodiment of the converter 15 is shown schematically in FIG. 2. The metallic housing part 13 which is circular in cross section is hermetically sealed gas tight on one side by the metallic converter membrane 17 as described above, for example, with a weld connection. On the inside of the membrane 17, there is a thin, piezoceramic wafer which is joined mechanically secured to the membrane 17 by means of an electrically conductive cement connection. In this embodiment, this piezowafer represents the electromechanical converter element and thus, the converter/drive unit 19. The connection element 18 from FIG. 1 in this case, is the flat cement connection between the piezowafer and the membrane 17. Via the electrical signal feed through 16 which is also hermetically sealed tight, contact is made with the piezowafer on the inside electrode surface as represented by a schematic terminal 16*c*. On the other hand, contact is made with the piezowafer on the outside electrode surface via the metallic converter housing 14, since the converter housing 14 is electrically connected via the conductive cement to the outside electrode surface of the piezowafer. The electrical connection of one of two terminals 16*a* to the metallic housing 14 may be made by a conductive contact-making element 16*b*. As can be seen, the piezowafer which can be made circular is applied to the inside of the converter membrane 17 as an electromechanically active element which, together with the converter membrane, represents an electromechanically active heteromorph composite element. Here, as in a bimorph element, the piezoelectric transverse effect is used except that the partner of the composite here does not consist of a second piezoelectrically active element, but instead, consists of the passive converter membrane 17 of geometry similar to the piezowafer. The piezowafer can be provided with a very thin, electrically conductive coating on both sides which is used as the electrode surface and can consist especially of lead zirconate titanate. As can be appreciated, if an electrical field is applied to the piezowafer, the wafer changes its geometry, preferably in the radial direction, as a result of the transverse piezoeffect. Since extension or radial shortening is prevented by the mechanically strong connection to the passive converter membrane 17, sagging of the composite element takes place which is maximum in the middle with the corresponding edge support of the converter membrane.

The thickness of the converter membrane 17 and the thickness of the converter 19, i.e. the piezowafer, may be roughly the same and may be in the range of 0.05 mm to 0.15 mm. Furthermore, the converter membrane 17 and the piezowafer may have roughly the same E-modulus. As shown in FIG. 2, one especially simple and reliable structure is obtained when both the converter membrane 17 and the housing 14 are electrically conductive, the piezoelectric ceramic wafer being connected electrically conductively to the converter membrane 17 by an electrically conductive cement and the housing part forming one of at least two electric converter terminals. In the preferred embodiment, the radius of the converter membrane is preferably larger by a factor of 1.2 to 2.0, preferably a factor of roughly 1.4, than the radius of the piezoelectric ceramic wafer.

If an electrical alternating signal is placed on the terminals 16*a*, as a result of the transverse piezoelectric effect, rotationally symmetrical dynamic bending of the membrane 17 takes place perpendicularly to the membrane plane, which leads to the described acoustic radiation through the membrane 17. In the embodiment shown in FIG. 2 for example, there is no converter driver circuit 66 as in FIG. 1 to illustrate how low structural height of the entire converter 15 can be accomplished by using the piezoelectric drive element. This converter embodiment is therefore, structurally suitable especially for the embodiments of the present invention described below for installation in a hearing aid according to FIG. 5 and FIG. 8.

Figure 3:
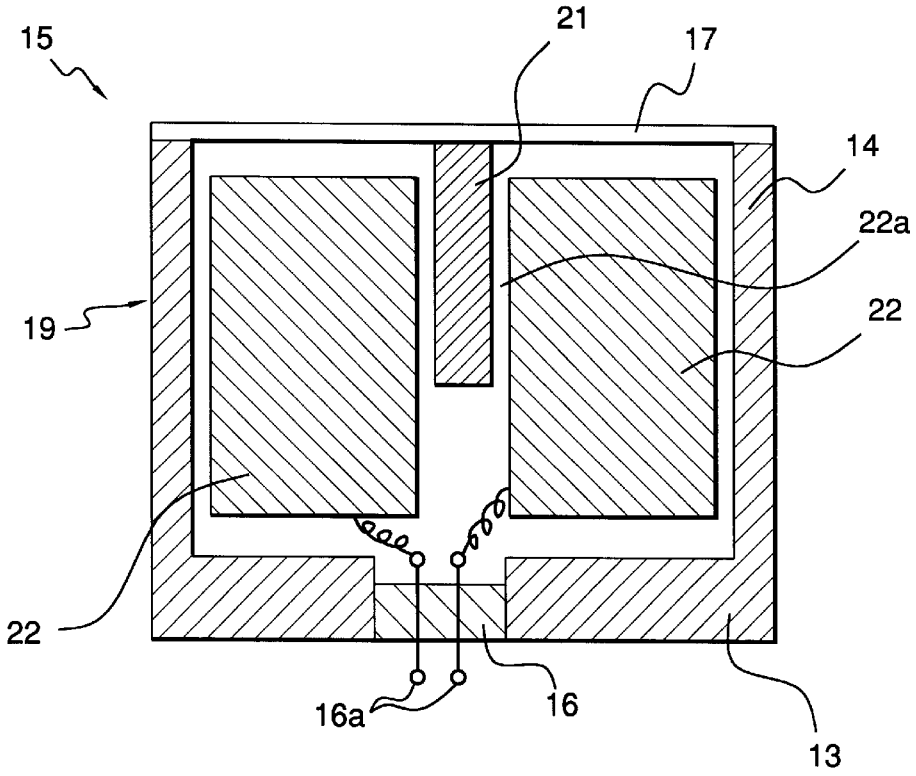
FIG. 3 shows a schematic cross-sectional view of a hearing aid converter in accordance with another embodiment of the present invention with an electromagnetic drive unit.

FIG. 3 shows another suitable embodiment of the hearing aid converter 15 in which the electromechanical converter drive unit 19 is based on the electromagnetic principle. The converter 15 has a converter housing 14 with a preferably cylindrical and mechanically rigid housing part 13. On one face of the housing part 13 which is preferably made circular, a bendable converter membrane 17 is applied thereby hermetically sealing the housing part 13. On the inside surface substantially in the middle of the converter membrane 17, a rod-shaped permanent magnet 21 is joined in a mechanically strong manner to the converter membrane 17 and projects into a central middle opening 22*a* of an electromagnetic ring coil 22 which, together with the permanent magnet 21, forms the converter drive unit 19. The coil 22 (shown in FIG. 3 as an air coil) is connected in a mechanically strong manner to the converter housing 14 and is electrically connected to the pole 16*a* of the hermetically sealed feed through 16.

When an AC voltage is applied to the coil 22, the magnet 21 undergoes dynamic deflection perpendicular to the plane of the membrane and thus, causes the membrane 17 to execute mechanical bending vibrations around the rest position. This in turn, leads to the desired sound radiation to the outside of the converter housing 13. In this way, a converter arrangement with an especially small moving mass is obtained which can promptly and faithfully follow the changes of the electrical signal applied to the coil 22. As can also be appreciated, it is also possible to attach the magnetic coil to the vibratory converter membrane 17 and to fix the magnet 21 with respect to the converter housing 14 instead. By using the electromagnetic converter principle, a converter frequency response, which is especially favorable for the low frequencies of the hearing range, can be achieved so that an adequate hearing impression is enabled with a sufficient loudness level using low electrical voltages.

Also, in this illustrated embodiment of the converter in FIG. 3, there is no electronic converter driver (corresponding to the driver 66 in FIG. 1) within the converter housing 14. However, it goes without saying that such a converter driver can also be integrated into the hearing aid converter 15 with the corresponding geometrical layouts and modification. Furthermore, the magnetic field guidance and thus, the efficiency of the converter, can be optimized by using the corresponding components within the converter housing 14 of suitable ferromagnetic materials with a corresponding geometrical design. This converter design with a suitable layout of coil parameters can have the advantage in that an existing electronic hearing aid circuit including the output stage which drives the converter, can be directly connected (for example, in class D, end stages which require the integrating function of electromagnetic converters).

FIG. 4 shows in schematic form, the desired behavior of the center point deflection $x_w$ of the converter membrane 17 over frequency f regardless of the selected implementation principle of the converter drive unit 19 within the converter for applications in which the transmission bandwidth should extend to at least 10 kHz. It is apparent that the first mechanical resonant frequency 23 is roughly 10 kHz, therefore, is spectrally at the top end of the transmission range desired. Thus, the higher resonances 24 (modes) are likewise, outside of the transmission range. This yields largely frequency-independent behavior of the radiated acoustic pressure in the auditory canal, assuming that the ear fitting piece described below adequately seals the outer auditory canal acoustically. Due to the lack of higher modes in the transmission range, the phase response remains flat as far as the first resonant frequency 23. This means that no phase rotations occur. This likewise, contributes greatly to unadulterated reproduction of the amplified audio signal and thus, to the overall transmission quality of the hearing aid.

The converter 15 is located on the housing 12 which faces the auditory canal of the user's ear. FIG. 5 schematically shows an example installation and use of the previously described converter in an in-the-ear hearing aid device hereinafter labeled 11. The in-the-ear hearing aid 11 is provided with the hearing aid housing 12 and is positioned in the known manner in the external ear area of the concha of the outer ear 5. Sound enters the hearing aid 11 via the sound inlet opening 55 and is converted by a microphone 60 into an electrical signal. This signal is processed and amplified in an electronic unit 65. The hearing aid 11 is supplied with electrical energy by a battery 70. The processed and amplified signal is sent to the converter 15 which is located directly in the end of the housing 12 of the in-the-ear hearing aid 11 such that the converter membrane 17 faces the auditory canal 30. The amplified acoustic signal produced by the converter membrane 17 is radiated directly into the auditory canal 30 and causes the eardrum 35 to vibrate and these vibrations lead to a hearing impression. If the hearing aid 11 sits acoustically as tightly as possible in the auditory canal 30, the acoustic signal radiated by the converter 15 is supplied to a nearby acoustic pressure chamber which is formed by the residual volume of the auditory canal and the eardrum. If, as described above, the deflection of the converter membrane 17 is independent of frequency as far as the spectrally upper end of the acoustic transmission range, the acoustic pressure level produced in the auditory canal 30 is independent of frequency, and as required, is flat with low rippling.

Since the converter membrane 17, as shown in FIG. 1, tightly seals the hearing aid housing 12 of the hearing aid 11 and the converter 15 is hermetically sealed gas tight by the converter membrane 17, no dirt or ear wax from the auditory canal 30 can penetrate the hearing aid 11 or the converter 15. The converter 15 is fundamentally protected against atmospheric humidity as a result of being hermetically gas tight. In addition, the converter membrane 17 can be easily cleaned by wiping it with wet media.

Likewise, regardless of the hearing aid type, the electroacoustic converter of the present invention can be accommodated in a separate housing and by at least one two-pole electrical line, be connected to the actual hearing aid which contains in the conventional manner a microphone, a power supply source, signal-processing and amplifying elements and all other possible components necessary for a hearing aid to function.

Figure 6:
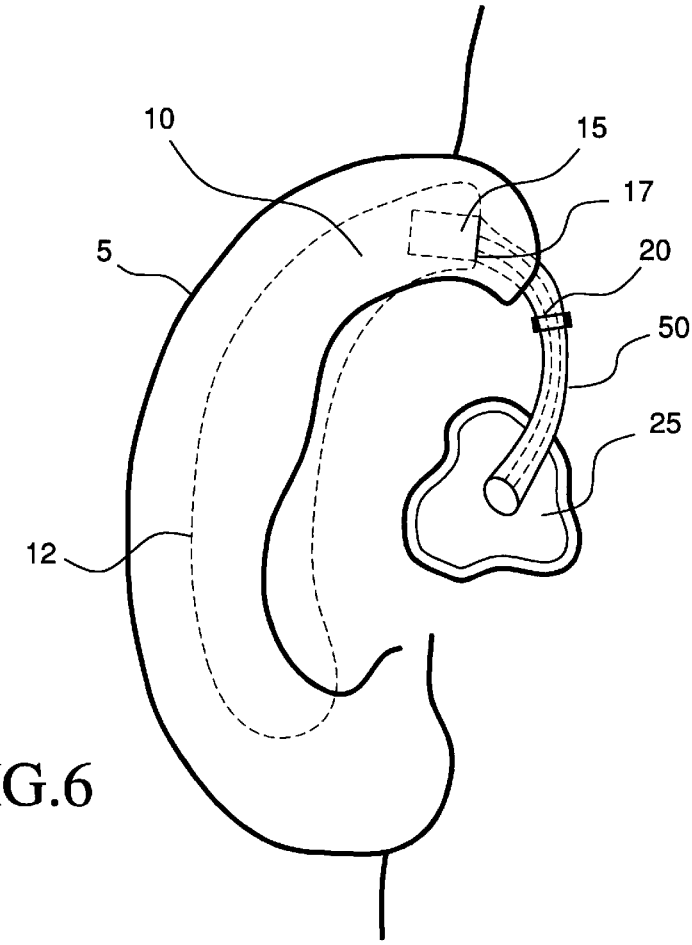
FIG. 6 shows a schematic illustration of a behind-the-ear device being worn by a user.
Figure 7:
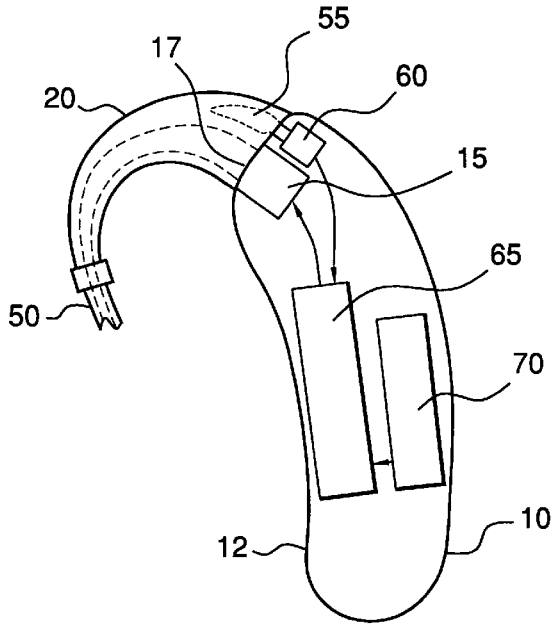
FIG. 7 shows a schematic illustration of a behind-the-ear device equipped with a hearing aid converter in accordance with the present invention.

FIGS. 6 and 7 schematically show the possible installation of the converter 15 in a behind-the-ear hearing aid (HdO) 10. The necessary components 55, 60, 65 and 70 correspond to those of the embodiment as shown in FIG. 5. The membrane 17 of the converter 15 which in turn is located on the end of the hearing aid housing 12 and in this case, radiates the acoustic signal into an open channel of a carrying hook 20. A sound conduction tube 50 which guides the amplified acoustic signal to the auditory canal, is mechanically connected to this carrying hook 20. This is shown schematically in FIG. 6. The sound conduction tube 50 discharges into an ear fitting piece 25 which is generally individually shaped (otoplasty) and sits acoustically as tightly as possible in the entry opening of the auditory canal. The acoustic signal is supplied to the auditory canal located behind the eardrum through a hole in the otoplasty.

Figure 8:
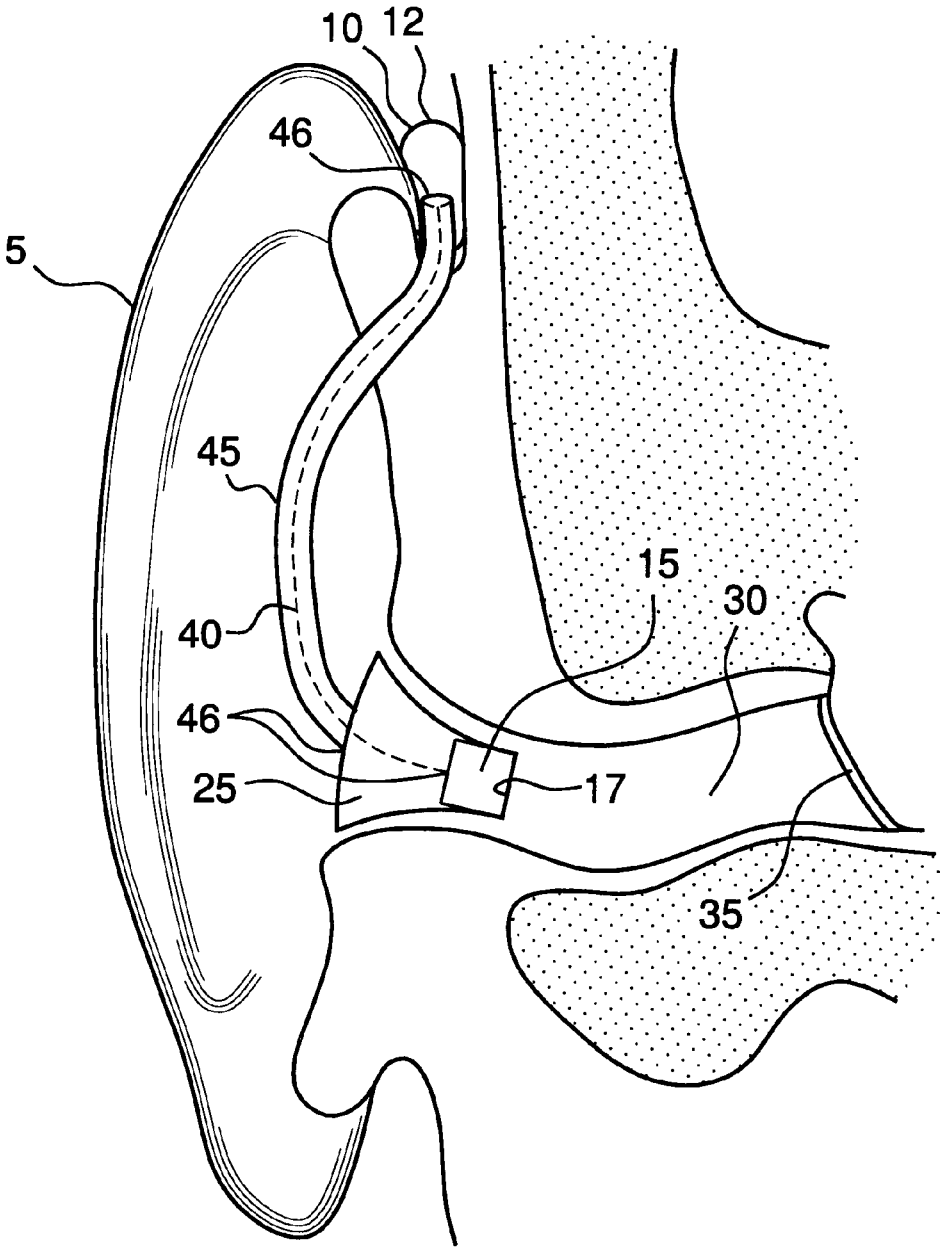
FIG. 8 shows a schematic illustration of a modified embodiment of a behind-the-ear device equipped with a hearing aid converter in accordance with the present invention.

FIG. 8 schematically shows another embodiment of a behind-the-ear hearing aid 10 using the present converter. In this embodiment, the converter 15 itself is accommodated in an ear fitting piece 25 which corresponds in its configuration to the known otoplasties of a behind-the-ear hearing aid or the housing shape of an in-the-ear aid, such ear fitting piece 25 being matched to the individual anatomic circumstances of the outer ear 5. The converter 15 is placed in the ear fitting piece 25 such that the sound-radiating converter membrane 17 is again, on the outer end of the fitting piece 25 that faces the auditory canal 30 and thus, faces the eardrum 35.

Between the actual hearing aid housing 12 which is worn behind the outer ear 5 and which contains a microphone, a corresponding electronic unit and a battery, as well as the converter 15, there is a purely electrical connection which is shown in FIG. 8 as an electrical converter supply line 40. The line 40 is advantageously guided in a mechanical supply line piece 45 which may be produced from plastic and which can be shaped and formed match the anatomy of the outer ear of the user.

Another practical advantageous embodiment of this type of supply line is that the supply line piece 45 is not connected in a mechanically and electrically rigid manner to the hearing aid 10 and/or the converter 15, but has detachable plug connections 46. In such an embodiment, it then becomes possible to replace any given component. Therefore, only the converter 15, or the converter 15 and the ear fitting piece 25, or only the supply line piece 45, or even all the components can be replaced. The detachable plug connections 46 can be made especially advantageously in the manner known from the European patent application EP-A-0 811 397.

The embodiment described in FIG. 8 has the advantage over the embodiments shown in FIGS. 6 and 7 in that the converter 15 radiates the conditioned acoustic signal (as in the in-the-ear version from FIG. 5) directly into the auditory canal 30 and thus, the known acoustic defects of a supply line tube 50 (see FIG. 6) are avoided. The advantage of a behind-the-ear design with a larger volume is preserved for the electronic signal processing unit 65 and the corresponding battery 70.

Figure 9:
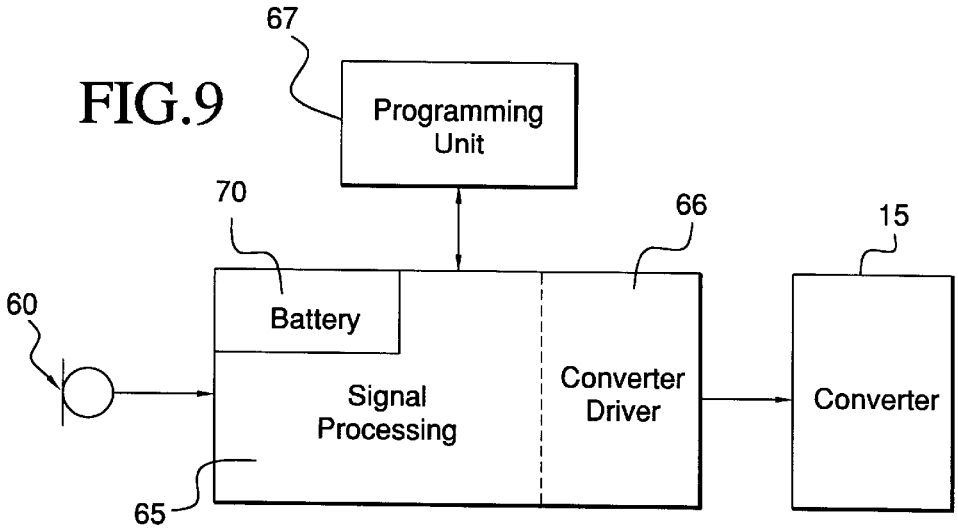
FIGS. 9 to 11 each schematically show an embodiment of electronic signal conditioning for use with the hearing aid converter in accordance with the present invention.
Figure 10:
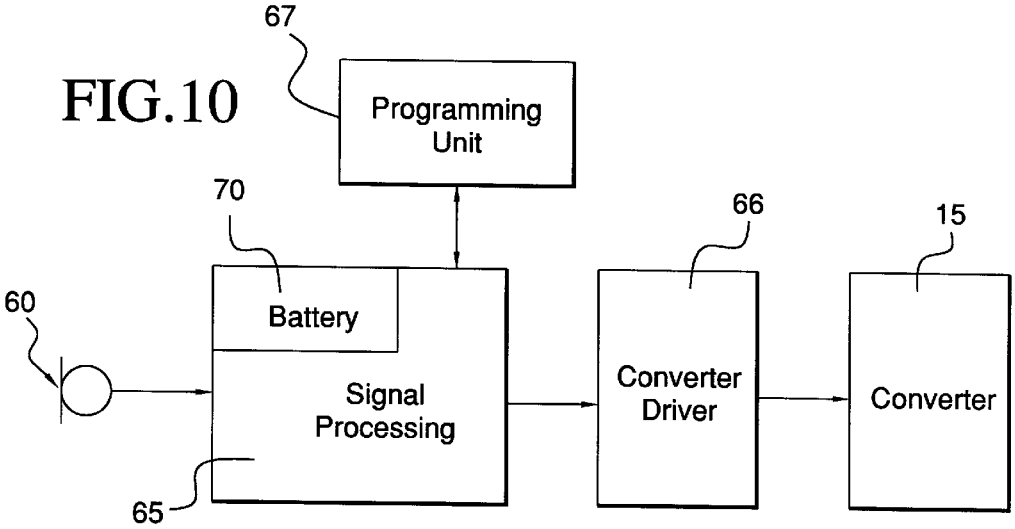
Figure 11:
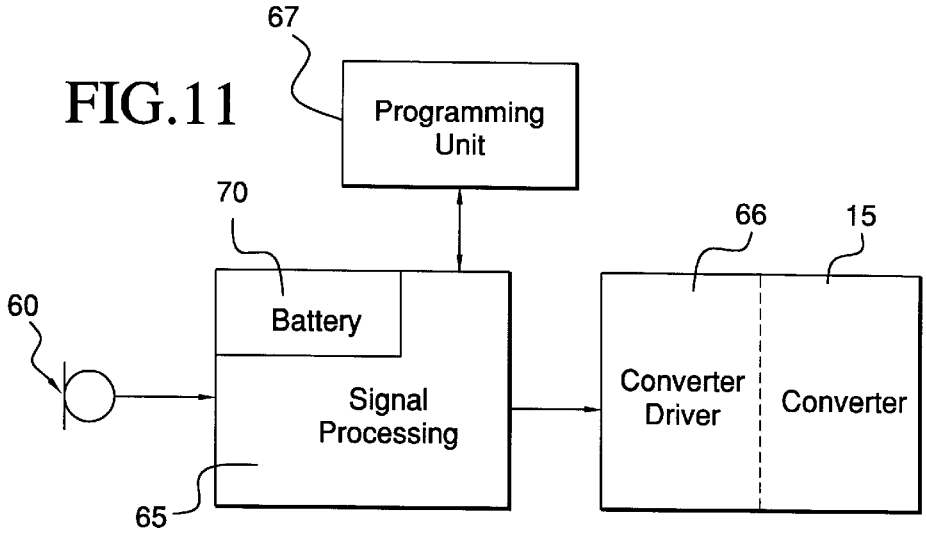

FIGS. 9 to 11 each show examples for possible embodiments of electronic signal conditioning of a hearing aid using the above described converter 15. Basically, the hearing aid includes the microphone 60, the electronic unit 65 which processes and amplifies the microphone signal, the battery 70 for supplying power to the entire hearing aid, the above described converter 15, the electronic converter driver 66, and an external, wireless or wired programming unit 67 through which the (fitting) parameters which are specific to the patient and to the system are stored and changed (either in analog or digital) in the hearing aid. In FIGS. 9, 10, and 11 the arrangement of the electronic converter driver 66 is different. As previously described, this converter driver 66 is provided as a matching electronic interface between the actual hearing aid electronics 65 and the electromechanical converter drive unit 19 in the converter 15.

FIG. 9 shows the converter driver 66 as a component of the signal processing electronics 65 of the hearing aid. It is integrated, for example, in an electronic circuit such as on a circuit chip.

In the embodiment as shown in FIG. 10, the converter driver 66 is located neither within the signal-processing electronics 65 of the hearing aid, nor in the converter 15, but instead, is connected between these two units. This embodiment means that the converter driver 66 is made and integrated as an independent single chip. The converter driver 66 is then, together with the signal-processing hearing aid electronics 65, accommodated within the hearing aid according to microelectronic construction techniques. Another embodiment based on the configuration of FIG. 10 can be that the converter driver circuit 66 is positioned outside the converter 15 and the behind-the-ear 10 or the in-the-ear hearing aid 11. The converter driver 66 may also be connected to the converter 15 and the hearing aid via suitable mechanical electrical connectors for service reasons. This version is used, for example, for the hearing aid arrangement shown in FIG. 8. For a converter driver 66 located outside the hearing aid housing, the electrical supply may be provided using the principle of phantom feed through a two-pole electrical connection between the hearing aid electronics and the converter driver 66, the DC voltage which supplies the converter driver 66 being superimposed on a signal-containing AC voltage. The converter driver can also be connected via detachable mechanical or electrical plug connections to the hearing aid or the electroacoustic converter.

FIG. 11 shows the implementation of the converter driver 66 within the housing of the converter 15. This corresponds to the general converter structure shown in FIG. 1.

Basically, the electronic converter driver 66 contains all necessary electronic and mechanical components which are necessary to be a matching electronic interface between the actual hearing aid (whether it be the behind-the-ear or in-the-ear hearing aid) and the converter 15, depending on the chosen electromechanical drive principle of the converter 15. There can be other audio amplifiers, DC/DC converters of all possible electronic implementations (among others, the known switched capacitor converters, inductor-based switching controllers, etc.), impedance converters, level-limiting elements, and other components which are used, for example, for electromagnetic compatibility. In particular, the driver unit 66 may, for example, contain an integrating component in order to be able to connect a piezoelectric converter 15 as shown in FIG. 2 to the digital, pulse-width modulated signal processing stage without the D/A converter of a fully digitally operating hearing aid.

While various embodiments in accordance with the present invention have been shown and described, it is understood that the invention is not limited thereto. These embodiments may be changed, modified and further applied by those skilled in the art. Therefore, this invention is not limited to the details shown and described previously but also includes all such changes and modifications which are encompassed by the appended claims.

I claim:

1. Electroacoustical hearing aid converter for converting an electric signal into an acoustical signal and for emitting the acoustical signal in the form of airborne sound into an outer auditory canal of a hearing aid user, said converter comprising:

an electromechanical converter drive unit having an output-side for providing mechanical vibration;

a hermetically sealed metallic converter housing for enclosing said drive unit; and a bendable converter membrane sealingly attached to said converter housing to form one wall of said converter housing;

wherein said output-side of said converter drive unit is coupled to said converter membrane in a manner that said converter membrane is excited into bending vibrations thereby resulting in airborne sound emission outside of said converter housing.

2. Converter of claim 1, wherein said electromechanical converter drive unit enclosed in said converter housing operates based on at least one of electromagnetic, electrodynamic, dielectric, piezoelectric, and magnetostrictive converter principles.

3. Converter of claim 2, wherein said electromechanical converter drive unit is an electromagnet arrangement with an electrical component fixed relative to said converter housing and a vibratory component coupled to an inside surface of said converter membrane.

4. Converter of claim 3, wherein said vibratory component is attached substantially centrally on said converter membrane.

5. Converter of claim 3, wherein said vibratory component is a permanent magnet connected to said inside surface of said converter membrane, and said electrical component is an electromagnetic coil attached to said converter housing for causing said permanent magnet to vibrate.

6. Converter of claim 5, wherein said permanent magnet is a magnetic pin and said electromagnetic coil is a ring coil with a middle opening in which said magnetic pin is movably disposed.

7. Converter of claim 1, wherein said converter housing has a cylindrical shape.

8. Converter of claim 1, wherein said converter membrane has a circular shape.

9. Converter of claim 1, wherein said converter housing includes a housing part with an open side which is hermetically sealed by said converter membrane.

10. Converter of claim 9, wherein said housing part is metallic.

11. Converter of claim 9, wherein said converter membrane is metallic.

12. Converter of claim 11, wherein said electromechanical converter drive unit is a piezoelectric ceramic wafer mechanically connected to an inside of said converter membrane to form an electromechanically active heteromorph composite element.

13. Converter of claim 12, wherein the piezoelectric ceramic wafer comprises lead zirconate titanate.

14. Converter of claim 12, wherein a thickness of said converter membrane and a thickness of said piezoelectric ceramic wafer are substantially equal and the thicknesses are in a range between 0.025 mm to 0.15 mm.

15. Converter of claim 12, wherein said converter membrane and said piezoelectric ceramic wafer have substantially equal E-modulus.

16. Converter of claim 12, wherein both said converter membrane and said housing part are electrically conductive, said piezoelectric ceramic wafer being electrically connected to said converter membrane by an electrically conductive cement, and said housing part forming one of at least two electric converter terminals.

17. Converter of claim 12, wherein said converter membrane and said piezoelectric ceramic wafer have a circular shape with a radius of the converter membrane being larger than a radius of the piezoelectric ceramic wafer by a factor in a range between 1.2 to 2.0.

18. Converter of claim 9, wherein at least one of said housing part and said converter membrane are made of a stainless, corrosion resistant metal.

19. Converter of claim 18, wherein said stainless, corrosion resistant metal is selected from a group consisting of steel, titanium, platinum, niobium, tantalum and their alloys.

20. Converter claim 9, wherein said housing part includes a hermetically sealed electrical housing feed through.

21. Converter of claim 20, wherein a ground potential provided on said housing part and said housing feed through includes at least a single-pole.

22. Converter of claim 20, wherein said housing feed through is a metal-ceramic connection soldered to be gas sealed.

23. Converter of claim 22, wherein said housing feed through includes an insulating portion made of an aluminum oxide ceramic and a electrical lead made of platinum-iridium wire.

24. Converter of claim 1, wherein mechanical properties of said converter membrane and said converter drive unit are selected in a manner that a first mechanical resonant frequency of said electroacoustic converter is tuned to be spectrally at a top end of a transmission range of said converter.

25. Converter of claim 24, wherein said first mechanical resonant frequency of said converter is in a range between 4 to 12 kHz.

26. Converter of claim 24, wherein said converter drive unit is electrically triggered in a manner that said converter membrane is deflected independently of said first mechanical resonant frequency.

27. Converter of claim 1, further comprising a converter driver enclosed in said converter housing.

28. Converter of claim 1, wherein said converter housing is adapted to be mounted in a hearing aid housing of at least one of a behind-the-ear hearing aid, in-the-ear hearing aid, and an eye glass hearing aid.

29. Converter of claim 28, wherein said converter housing is mounted in a separate housing and includes at least one two-pole electrical line for electrical connection to said hearing aid which includes a microphone, a power supply source, signal-processing and amplifying elements.

30. Converter of claim 29, wherein said converter housing is installed in an ear fitting piece.

31. Converter of claim 30, wherein said electromechanical converter drive unit is supplied with an electrical supply via an electrical supply line contained in a flexibly deformable coupling element.

32. Converter of claim 30, wherein said converter membrane ends substantially flush with area of said ear fitting piece which faces an auditory canal of the ear.

33. Converter of claim 28, further comprising an electronic converter driver for matching output of said converter drive unit to an output signal from a signal processing electronic of said hearing aid.

34. Converter of claim 33, wherein said converter driver has an integrating function for connecting a pulse-width modulated output stage provided in said hearing aid.

35. Converter of claim 33, wherein said converter driver is integrated in said signal-processing electronics of said hearing aid.

36. Converter of claim 33, wherein said converter driver is an independent electronic module.

37. Converter of claim 36, wherein said independent electronic module is accommodated in said hearing aid housing.

38. Converter of claim 36, wherein independent electronic module is accommodated in said converter housing.

39. Converter of claim 36, wherein said converter driver is connected to said hearing aid via a detachable plug connection.

40. Converter of claim 33, wherein said converter driver is provided with an electrical supply via a two-pole electrical connection between said hearing aid electronics and said converter driver, DC voltage which supplies said converter driver being superimposed on a signal-containing AC voltage.

* * * * *